US010533271B2

(12) United States Patent
Miyauchi et al.

(10) Patent No.: US 10,533,271 B2
(45) Date of Patent: Jan. 14, 2020

(54) CONJUGATE FIBER FOR AIR-LAID NONWOVEN FABRIC MANUFACTURE AND METHOD FOR MANUFACTURING A HIGH-DENSITY AIR-LAID NONWOVEN FABRIC

(71) Applicants: ES FiberVisions Co., Ltd., Osaka-shi, Osaka (JP); ES Fibervisions Hong Kong Limited, Kowloon (HK); ES Fibervisions LP, Athens, GA (US); ES Fibervisions ApS, Varde (DK)

(72) Inventors: Minoru Miyauchi, Osaka (JP); Takayuki Nishitani, Osaka (JP); Masashi Teranaka, Osaka (JP)

(73) Assignees: ES FIBERVISIONS CO., LTD., Osaka (JP); ES FIBERVISIONS HONG KONG LIMITED, Kowloon (HK); ES FIBERVISIONS LP, Athens, GA (US); ES FIBERVISIONS APS, Varde (DK)

( * ) Notice: Subject to any disclaimer, the term of this patent is extended or adjusted under 35 U.S.C. 154(b) by 850 days.

(21) Appl. No.: 14/808,853

(22) Filed: Jul. 24, 2015

(65) Prior Publication Data

US 2015/0330002 A1 Nov. 19, 2015

Related U.S. Application Data

(62) Division of application No. 12/993,737, filed as application No. PCT/JP2009/059481 on May 19, 2009.

(30) Foreign Application Priority Data

May 19, 2008 (JP) ..... 2008-131090

(51) Int. Cl.

| | |
|---|---|
| ***D04H 1/732*** | (2012.01) |
| ***D06C 7/00*** | (2006.01) |
| ***D01F 8/06*** | (2006.01) |
| ***D04H 1/4382*** | (2012.01) |
| ***D04H 1/4391*** | (2012.01) |
| ***D04H 1/50*** | (2012.01) |

(52) U.S. Cl.

CPC ..... *D04H 1/732* (2013.01); *D01F 8/06* (2013.01); *D04H 1/4382* (2013.01); *D04H 1/4391* (2013.01); *D04H 1/50* (2013.01); *D06C 7/00* (2013.01); *D10B 2321/022* (2013.01); *Y10T 428/2924* (2015.01)

(58) Field of Classification Search

CPC ..... D04H 1/732; D04H 1/06; D04H 1/4382; D04H 1/4391; D04H 1/50; D04H 1/541; D01D 5/32; D01F 8/06; D06C 7/00

USPC ..... 442/163, 103, 327; 428/370; 264/168, 264/103

See application file for complete search history.

(56) References Cited

U.S. PATENT DOCUMENTS

| | | | |
|---|---|---|---|
| 3,900,678 | A | 8/1975 | Aishima et al. |
| 4,269,888 | A | 5/1981 | Ejima et al. |
| 5,227,224 | A | 7/1993 | Ishikawa et al. |
| 2004/0234757 | A1 | 11/2004 | Goda |
| 2006/0182964 | A1 | 8/2006 | Goda |

FOREIGN PATENT DOCUMENTS

| | | |
|---|---|---|
| EP | 0365943 | 5/1990 |
| EP | 1452633 | 9/2004 |
| JP | 02-127553 | 5/1990 |
| JP | 05-78916 | 3/1993 |
| JP | 2003-166127 | 6/2003 |
| JP | 2003-171860 | 6/2003 |
| JP | 2005-188000 | 7/2005 |
| WO | 2009/078479 | 6/2009 |

OTHER PUBLICATIONS

Machine translation of JP-2005188000.*
Machine translation of JP-H05-078916.*

* cited by examiner

*Primary Examiner* — Vincent Tatesure
(74) *Attorney, Agent, or Firm* — Hamre, Schumann, Mueller & Larson, P.C.

(57) ABSTRACT

Provided is a conjugate fiber for air-laid nonwoven fabric manufacture having a planar zig-zag crimp shape before a thermal treatment, such that a uniform web is obtained by air laying with high processability and productivity, and the conjugate fiber develops a spiral crimp when the web is subjected to a thermal treatment to thereby enable the web to shrink significantly, as a result of which a nonwoven fabric can be obtained in which fibers are amassed to a high density.

The conjugate fiber for air-laid nonwoven fabric manufacture is a heat-fusible conjugate fiber in which a first component comprising an olefinic thermoplastic resin is conjugated with a second component comprising an olefinic thermoplastic resin having a melting point higher than that of the first component. The conjugate form is such that the centers of gravity of the conjugate components are mutually different in the fiber cross section, the fiber has a single-yarn fineness of 1 to 10 dtex, a fiber length of 3 to 20 mm, and a planar zig-zag crimp whose crimp shape index (actual length of short fiber/distance between both ends of short fiber) ranges from 1.05 to 1.60, and the web shrinkage upon thermal treatment at 145° C. of a web obtained by an air-laid method is not lower than 40%.

11 Claims, No Drawings

CONJUGATE FIBER FOR AIR-LAID NONWOVEN FABRIC MANUFACTURE AND METHOD FOR MANUFACTURING A HIGH-DENSITY AIR-LAID NONWOVEN FABRIC

TECHNICAL FILED

The present invention relates to a conjugate fiber that allows obtaining a high-density and high-basis weight air-laid nonwoven fabric. More particularly, the present invention relates to a conjugate fiber excellent in air-laying processability and productivity, having only planar crimp, so-called zig-zag crimp, before a thermal treatment, such that when an air-laid web manufactured using the conjugate fiber is subjected to a thermal treatment, latent crimp is brought out as a spiral crimp that allows the web to shrink significantly, as a result of which there is obtained a high-density and high-basis weight air-laid nonwoven fabric.

The present invention further relates to a method for manufacturing a high-density air-laid nonwoven fabric using such a conjugate fiber.

BACKGROUND ART

Conjugate fibers having latent crimp that is developed into a spiral crimp, on account of shrinkage differences during a thermal treatment, are used, for instance, in stretchable nonwoven fabrics, high-cushioning nonwoven fabrics and liquid absorbing nonwoven fabrics. These conjugate fibers are made into webs mainly by way of a carding process, after which the spiral crimp is brought out in a thermal treatment in which the web shrinks to yield the nonwoven fabric. In the nonwoven fabric, therefore, the fibers are packed to a higher density than when in the web state, and are also entangled with each other on account of the spiral crimp. These features make for excellent stretchability, cushioning characteristics, as well as liquid absorption and release characteristics.

However, nonwoven fabrics obtained by way of a carding process have shortcomings in that the properties of the nonwoven fabric are not isotropic since the way in which fibers are arranged is different in the machine direction and the width direction. Patent document 1 discloses the feature of obtaining a nonwoven fabric, having substantial elastic recovery, by forming a latently crimp able conjugate fiber into a web, entangling the fibers using a water needle or the like, and developing then spiral crimp by way of a thermal treatment. In this nonwoven fabric, however, the fibers are arranged in the machine direction, and hence, although the nonwoven fabric exhibits excellent strength and elastic recovery in the machine direction, both strength and elastic recovery are remarkably small in the width direction.

An appropriately high existence density of fiber is particularly important in liquid absorbing nonwoven fabrics. To achieve a high-density nonwoven fabric, a low-density nonwoven fabric is ordinarily compacted using a high-temperature calendering roll. Alternatively, straight fibers having no crimp imparted thereto are made into a nonwoven fabric in accordance with a papermaking method. In these nonwoven fabrics, however, fibers are thermal fusion bonded each other existing excessively close. The resulting nonwoven fabric is hard, and the size of voids between fibers is insufficient, all of which often renders the nonwoven fabric unsuitable for absorbing and releasing liquids.

By contrast, nonwoven fabrics obtained by subjecting a web comprising the above-described latently crimpable conjugate fibers to a thermal treatment, to bring out thereby a spiral crimp that causes the web to shrink, are suitable for liquid absorption and release, and exhibit a somewhat high fiber existence density. Such nonwoven fabrics are preferably used in that, moreover, the size of the voids created by the spiral crimp affords good liquid absorption and release characteristics. The carding process itself, however, has limits as regards basis weight. For instance, it has proved impossible to obtain, stably and with good productivity, liquid absorbing nonwoven fabrics having a high basis weight of 500 g/m$^2$ or more. In webs obtained by a carding process, the fibers exhibit considerable distribution as regards degree of freedom. Portions with a high degree of freedom result in higher density through shrinking, whereas portions with a low degree of freedom result in low density, on account of little shrinking. This tends to yield a nonwoven fabric of uneven texture derived from biased web shrinking. To solve this problem, it becomes then necessary to carry out a further process for interlacing fibers, by way of a water needle or the like, before causing the fibers to develop a spiral crimp by thermally treating the web, as disclosed in patent document 1. Such an approach detracts considerably from workability and productivity.

Air-laying processes are effective in order to overcome the above problems of property anisotropy and inadequacy for high-basis weight articles, by easily affording high-basis weight nonwoven fabrics boasting small differences in fiber arrangement in the machine direction and the width direction. However, there were problems that processability and productivity ordinarily became extremely low when latently crimp able conjugate fiber was applied to the air-laying process. Such poor processability and productivity are caused by the high bulk of latently crimp able conjugate fibers, the ready spreading of the fibers and the ready entangling of the spread fibers, which arise in turn from a considerable three-dimensional crimp shape, or planar but curved crimp shape, derived from the cross-sectional shape of the fiber.

Patent documents 2 and 3 disclose ways of obtaining high-bulkiness nonwoven fabrics by using, in an air laying process, latently crimpable fibers having a two-dimensional crimp such as zig-zag crimp or Ω-like crimp before a thermal treatment, such that the fibers develop a three-dimensional crimp after web formation. The crimp of the fibers is herein a two-dimensional crimp, such as zig-zag crimp or Ω-like crimp, with a view to improving air-laying processability. However, although the fibers developed a three-dimensional crimp by way of a thermal treatment, the crimp-eliciting power of the fibers was weak, and the web itself failed to shrink with high shrinkage. Therefore, the nonwoven fabrics exhibited low fiber existence density, insufficient three-dimensional isotropy, insufficient stretchability and cushioning characteristics, and insufficient liquid absorption characteristics. Moreover, the component used in the fibers was a polyester resin. This was problematic in that polyester resins have poor chemical resistance, and hence the nonwoven fabric was not suitable for alkaline liquids or the like, when used as a liquid absorbing nonwoven fabric.

Patent document 1: JP 02-127553 A
Patent document 2: JP 2003-166127 A
Patent document 3: JP 2003-171860 A

DISCLOSURE OF THE INVENTION

There have been thus attempts at obtaining a nonwoven fabric having excellent stretchability, cushioning characteristics and liquid absorbing ability, by using latently crimp able conjugate fibers, attempts at using latently crimp able fibers in air laying processes, and attempts at obtaining high-basis weight nonwoven fabrics, having small property differences in the machine direction and the width direction, by way of an air laying process. However, such attempts have failed hitherto to achieve simultaneously high fiber existence density through web shrinking, coupled with air laying process processability and productivity. This underscores the need for further improvement.

Therefore, it is an object of the present invention to provide a conjugate fiber for manufacturing a high-density air-laid nonwoven fabric, the conjugate fiber having a planar zig-zag crimp shape before a thermal treatment, such that a uniform web is obtained by air laying with high processability and productivity, and the conjugate fiber develops a spiral crimp when the web is subjected to a thermal treatment to thereby enable the web to shrink significantly, as a result of which a nonwoven fabric can be obtained in which fibers are amassed to a high density.

Another object of the present invention is to provide a method for manufacturing a high-density air-laid nonwoven fabric using the above conjugate fiber.

As a result of diligent research directed at solving the above problems, the inventors found that a uniform air-laid web, excellent in air-laying processability and productivity, can be obtained by using a conjugate fiber obtained by conjugating an olefinic thermoplastic resin of low melting point, and an olefinic thermoplastic resin having a melting point higher than that of the low-melting point olefinic thermoplastic resin, such that the centers of gravity of the conjugate components are mutually different in the fiber cross section. The inventors found also that the crimp develop ability of such a conjugate fiber is excellent during thermal treatment of the web, as a result of which the web shrinks significantly, affording a high-density nonwoven fabric in which fibers are amassed to a high density. The inventors found that yet better results are achieved, in particular, when using homopolypropylene having a molecular weight distribution (number-average molecular weight/weight-average molecular weight) not smaller than 3.5 as the high-melting point olefinic thermoplastic resin. The inventors achieved the present invention on the basis these findings.

Accordingly, the present invention has the features below.

(1) A conjugate fiber for air-laid nonwoven fabric manufacture, being a heat-fusible conjugate fiber in which a first component comprising an olefinic thermoplastic resin is conjugated with a second component comprising an olefinic thermoplastic resin having a melting point higher than that of the first component, wherein the conjugate form is such that the centers of gravity of the conjugate components are mutually different in the fiber cross section, the fiber has a single-yarn fineness of 1 to 10 dtex, a fiber length of 3 to 20 mm, and a planar zig-zag crimp whose crimp shape index (actual length of short fiber/distance between both end of short fiber) ranges from 1.05 to 1.60, and the web shrinkage upon thermal treatment at 145° C. of a web obtained by an air-laid method is not lower than 40%.

(2) The conjugate fiber for air-laid nonwoven fabric manufacture according to (1), wherein the conjugate form in the fiber cross section is a side-by-side shape in which a crescent-shaped first component and a crescent-shaped second component are bonded together.

(3) The conjugate fiber for air-laid nonwoven fabric manufacture according to (1) or (2), wherein the first component is a polypropylene copolymer and the second component is homopolypropylene.

(4) The conjugate fiber for air-laid nonwoven fabric manufacture according to (3), wherein the molecular weight distribution (weight-average molecular weight/number-average molecular weight) of the homopolypropylene of the second component is not smaller than 3.5.

(5) The conjugate fiber for air-laid nonwoven fabric manufacture according to any one of (1) to (4), wherein short fiber bulkiness is no greater than 250 $cm^3/2$ g.

(6) The conjugate fiber for air-laid nonwoven fabric manufacture according to any one of (1) to (5), wherein a discharge efficiency during forming in an air-laying machine is not lower than 80%, and the number of defects in the web obtained by forming is no greater than $3/m^2$.

(7) A method for manufacturing a nonwoven fabric, comprising: thermally treating a web obtained through an air laying process of a heat-fusible conjugate fiber in which a first component comprising an olefinic thermoplastic resin is conjugated with a second component comprising an olefinic thermoplastic resin having a melting point higher than that of the first component, the conjugate form being such that the centers of gravity of the conjugate components are mutually different in the fiber cross section, the fiber having a single-yarn fineness of 1 to 10 dtex, a fiber length of 3 to 20 mm, a planar zig-zag crimp whose crimp shape index (actual length of short fiber/distance between both ends of short fiber) ranges from 1.05 to 1.60, and a crimp count ranging from 6 to 14 crimps/2.54 cm.

Although the conjugate form of the conjugate fiber for air-laid nonwoven fabric manufacture of the present invention is a form in which the centers of gravity of the components are different in the fiber cross section, the crimp shape of the fiber is a completely planar zig-zag crimp shape, with a crimp shape index ranging from 1.05 to 1.60, and a crimp count no greater than 14 crimps/2.54 cm, at a stage before a thermal treatment. Therefore, the bulkiness of the fiber is small, and in consequence, the conjugate fiber of the present invention exhibits excellent fiber spreadability and dispersibility, as well as dischargeability from a drum screen or a screen mesh, when processed in an air laying process. The conjugate fiber of the present invention allows thus obtaining a web of good texture with high productivity.

When the obtained web is subjected to a thermal treatment, the fibers develop a spiral crimp, with a remarkable shortening of apparent fiber length, derived from the cross-sectional shape of the fiber and the thermal shrinkage differences between components. This spiral crimp development causes the web to shrink significantly and the fibers to become amassed to a high density. The spiral crimp elicits also adequate entanglement between fibers, as a result of which there is obtained a high-density air-laid nonwoven fabric having excellent stretchability, cushioning characteristics as well as liquid absorption and release characteristics.

This high-density air-laid nonwoven fabric is obtained by way of an air laying process, and hence a high-basis weight nonwoven fabric of, for instance, 500 $g/m^2$ or more can easily obtained. Moreover, differences in fiber arrangement in the machine direction and the width direction are very small, and thus differences in the properties of the nonwoven fabric in the two directions are likewise small. In such an air-laid web laid to a high basis weight, furthermore, there is an appreciable number of fibers arranged at a certain angle in the vertical direction. During web shrinking through a thermal treatment, these fibers arranged in the vertical direction become bulked up and raised in the vertical direction through the opposing effect of contractile forces in the horizontal direction, while shrinking by developing their own spiral crimp. As a result there is effectively achieved a high-density air-laid nonwoven fabric having high bulkiness and good stretchability and cushioning in the thickness direction of the nonwoven fabric, and exhibiting little property differences in the three spatial directions, i.e. the machine direction, the width direction and the thickness direction. When the air-laid nonwoven fabric is used, for instance, as a liquid absorbing material, it is found that the nonwoven fabric exhibits little differences in liquid absorption and release characteristics in the three spatial directions, while when the nonwoven fabric is used as a cushioning material, it is found that the nonwoven fabric exhibits high compression recovery characteristics in all directions.

BEST MODE FOR CARRYING OUT THE INVENTION

The present invention will be explained next in detail on the basis of embodiments.

The conjugate fiber for air-laid nonwoven fabric manufacture of the present invention comprises a first component comprising an olefinic thermoplastic resin, and a second component comprising an olefinic thermoplastic resin having a melting point higher than that of the first component.

The olefinic resin of the first component is not particularly limited, and may be, for instance, polypropylene, a polypropylene copolymer being a copolymer of propylene and an α-olefin (such as ethylene, butene-1, octene, 4-methyl pentene or the like); an ethylene polymer such as high-density polyethylene, medium-density polyethylene, low-density polyethylene, linear low-density polyethylene or the like; or polymethyl pentene.

Likewise, the polymer used as the olefinic polymer of the second component is not particularly limited, and may be the same olefinic resin as exemplified for the first component. However, the melting point of the olefinic polymer of the second component must be higher than that of the first component. Accordingly, examples of combinations of first component/second component may be, for instance, high-density polyethylene/polypropylene, medium-density polyethylene/polypropylene, low-density polyethylene/polypropylene, linear low-density polyethylene/polypropylene, a polypropylene copolymer/polypropylene, low-density polyethylene/a polypropylene polymer, a polypropylene copolymer/a polypropylene copolymer, a polypropylene polymer/polymethylpentene. In these resins, the "polypropylene polymer" may be polypropylene or a polypropylene copolymer.

As the first component and the second component there may be used one type of olefinic thermoplastic resin singly, or a mixture of two or more types of olefinic thermoplastic resin, as long as the effect of the present invention is not compromised thereby. To the first component and second component there may be appropriately added, as the case may require, various additives for bringing out various properties. These additives include, for instance, antioxidants, light stabilizers, UV absorbents, neutralizers, nucleating agents, lubricants, bactericides, deodorizing agents, flame retardants, antistatic agents, pigments, plasticizers and the like.

The conjugate fiber for air-laid nonwoven fabric manufacture of the present invention is formed into a web by an air laying process. When the web is subjected to a thermal treatment for 5 minutes at 145° C. in a circulating oven, the conjugate fibers develop a spiral crimp, which reduces the apparent fiber length and induces high web shrinking. Web shrinkage is not lower than 40%, more preferably not lower than 50%. The web exhibits high shrinking when web shrinkage is herein not lower than 40%. The fibers can become amassed as a result to a high density. Also, web shrinking causes the basis weight, defined as weight per unit surface area, to increase, whereby there can be easily obtained a high-basis weight high-density air-laid nonwoven fabric. A web shrinkage not lower than 50% elicits the above effects to a greater degree, and is hence preferable. When the web shrinkage of the conjugate fiber for air-laid nonwoven fabric manufacture of the present invention becomes excessive in an attempt to obtain a desired air-laid nonwoven fabric, this excessive shrinkage can be counteracted by lowering the temperature of the thermal treatment to which the web is subjected to, or by shortening the duration of the thermal treatment. That is, the scope of the thermal treatment conditions of the air-laid web becomes wider when web shrinkage is large, and hence the upper limit of web shrinkage during thermal treatment for 5 minutes at 145° C. in a circulation oven is not particularly limited, the upper limit being more preferable the higher it is set.

The shrinkage of the air-laid web can be specifically determined by taking samples of an air-laid web having a size of 25 cm×25 cm=machine direction×width direction, heating the samples for 5 minutes at 145° C. in a circulation oven, and by measuring and averaging then the shrinkage of the web in the machine direction and the width direction.

Although not particularly limited thereto, the melting point of the first component of the conjugate fiber for air-laid nonwoven fabric manufacture of the present invention ranges preferably from 80° C. to 150° C., more preferably from 120 to 145° C., in order to achieve a shrinkage not lower than 40% in the air-laid web. Ordinarily, olefinic thermoplastic resins having a low melting point tend to exhibit high surface friction. The presence of such resins on the surface of the fibers causes fiber friction to increase, detracts from workability during fiber manufacture, and impairs air laying processability. However, setting a melting point of the first component of 80° C. or higher affords acceptable fiber productivity and air laying processability, while setting a melting point of 120° C. or higher affords sufficient fiber productivity and air laying processability. When the melting point of the first component is high, shrink characteristics during the thermal treatment become poorer, and shrinking requires a high-temperature thermal treatment. Herein, satisfactory shrink characteristics can be obtained when the melting point of the first component is not higher than 150° C., while sufficient shrink characteristics can be obtained when the melting point of the first component is not higher than 145° C.

The melting point of the second component of the conjugate fiber for air-laid nonwoven fabric manufacture of the present invention is not particularly limited, but is higher than the melting point of the olefinic resin of the first component, and ranges preferably from 140 to 200° C., more preferably from 155 to 170° C. A low melting point of the second component gives reduction in stiffness during the thermal treatment, and is liable to afford a hard nonwoven fabric. However, the reduction in stiffness can be limited to a satisfactory level when the melting point of the second component is not lower than 140° C., while a sufficient degree of bulking can be preserved when the melting point of the second component is not lower than 155° C. When the melting point of the second component is high, shrink characteristics during the thermal treatment become poorer, and shrinking requires a high-temperature thermal treatment. However, satisfactory shrink characteristics can be obtained when the melting point of the second component is not higher than 200° C., while sufficient shrink characteristics can be obtained when the melting point of the second component is not higher than 170° C.

The melting point difference between the first component and the second component of the conjugate fiber for air-laid nonwoven fabric manufacture of the present invention is not particularly limited, although the melting point difference is preferably not smaller than 10° C., more preferably not smaller than 20° C. A melting point difference not smaller than 10° C. allows forming a spiral crimp, through thermal treatment, thanks to the difference in shrinkage between the two components, and allows the web to shrink significantly. A melting point difference not smaller than 20° C. causes the pitch of the spiral crimp to become smaller, and affords a greater crimp forming power. In turn, this allows the web to shrink yet more significantly.

With a view to achieving an air-laid web shrinkage of 40% or more, the combination of olefinic polymers that make up the conjugate fiber for air-laid nonwoven fabric manufacture of the present invention is preferably a combination, in particular, of polypropylene copolymer/polypropylene (homopolypropylene) from among the above-described olefinic polymers. Such a combination has a strong ability for eliciting spiral crimp and results in a shorter apparent fiber length by causing the fiber to develop a small-pitch spiral crimp. This strong ability for eliciting spiral crimp causes the fiber to deform in such a manner that surrounding fibers are dragged into the movement of the deformation during thermal treatment of the web, as a result of which the web shrinks significantly.

As described above, a greater melting point difference between the two components results in higher web shrinking. However, the lower the melting point of the polyolefin copolymer, which is the first component, the higher the friction on the resin surface, and agglutination between fiber surfaces becomes easy to occur, which makes fiber formation harder. Therefore, although no particular limitation is imposed on the melting point difference between the two components of the conjugate fiber, namely between the first component, which is a polypropylene copolymer, and the second component, which is polypropylene, the melting point difference ranges preferably from 10 to 40° C., more preferably from 20 to 30° C. A melting point difference between both components of 10° C. or more is preferable, since it allows the web to shrink significantly through development of spiral crimp. The melting point difference between the two components is preferably no greater than 40° C., since in that case the friction of the first component does not become excessive, nor do fibers readily agglutinate with each other, and no loss of workability or productivity loss is incurred during fiber formation. A melting point difference between the two components ranging from 20 to 30° C. is more preferable, since this range is superior in terms of striking a balance between web shrinking characteristics and workability and productivity during fiber formation. A polypropylene copolymer having an appropriate copolymer composition may be selected in order to achieve a melting point difference lying within the above ranges.

To achieve a shrinkage of 40% or more in the air-laid web that comprises the conjugate fiber for air-laid nonwoven fabric manufacture of the present invention, it is important to adopt a conjugate form such that the center of gravity of the first component and the center of gravity of the second component are mutually different in the cross section of the conjugate fiber. When the conjugate form is such that the centers of gravity of the components are mutually different, the difference in shrinkage behavior between the two components gives rise to a three-dimensional spiral crimp during thermal treatment of the conjugate fiber, with the component having the larger shrinkage on the inward side and the component having the smaller shrinkage on the outward side. As a result of the spiral crimp thus developed, fiber length shortens markedly, in such a manner that surrounding fibers are involved, causing the web to shrink. Examples of the conjugate form include, for instance, side-by-side, eccentric core/sheath, and split forms. These forms can be achieved using ordinary side-by-side type nozzles, eccentric core/sheath type nozzles and split type nozzles.

Side-by-side conjugate forms, in particular side-by-side forms in which a half-moon-shaped first component and a half-moon-shaped second component are bonded together, are preferable among the foregoing, since they are superior in eliciting spiral crimp. The side-by-side cross section, in which the half-moon-shaped first component and the half-moon-shaped second component are bonded together, is achieved by using an ordinary side-by-side nozzle and by reducing the difference of melt flow rate (MFR) between the two components during ejection from the nozzle.

The MFR of the first component ejected from the nozzle is not particularly limited, but ranges preferably from 5 to 100 g/10 min, more preferably from 10 to 50 g/10 min. The MFR of the second component ejected from the nozzle is not particularly limited, but ranges preferably from 5 to 100 g/10 min, more preferably from 10 to 50 g/10 min. Spinning tension can be kept not excessively large, and the number of breaks can be reduced, when the MFRs of the first component and the second component are not lower than 5 g/10 min. When the MFRs of the first component and the second component are no greater than 100 g/10 min, the spinline is prevented from becoming unstable on account of an excessively small spinning tension, and hence workability is improved. In particular, an MFR range from 10 to 50 g/10 min is preferred, as it results in few breaks and affords good workability.

Reducing the MFR difference between the first component and the second component is also preferable in terms of achieving a fiber cross-section conjugate form that elicits high spiral crimp development through thermal treatment. The MFR difference between the first component and the second component is not particularly limited, but is preferably no greater than 10 g/10 min, and more preferably no greater than 5 g/10 min. When the MFR difference between the two components is no greater than 10 g/10 min, the fiber cross section resembles a shape in which two half-moon-shaped components are bonded together. When the MFR difference between the two components is no greater than 5 g/10 min, the fiber cross section is a perfect shape comprising two substantially perfect half-moon-shaped components bonded together. Development of spiral crimp resulting from shrinkage differences between the two components is most pronounced, and the air-laid web comprising the resulting conjugate fiber exhibits high shrinking thereby, when the half-moon-shaped two components are bonded in this shape.

The cross-sectional shape of the fibers is not particularly limited, as long as the conjugate form in the fiber cross section is any of the above. The fiber cross-sectional shape may be, for instance, round shape like circular type and oval type, triangular, quadrangular or otherwise polygonal, or an atypical shape such as a lock shape, an eight-petal shape or the like. The fiber cross-sectional shape may also be hollow.

The conjugate rate of the first component and the second component in the conjugate fiber for air-laid nonwoven fabric manufacture of the present invention is not particularly limited, but lies preferably in the range of first component/second component=75/25 to 35/65 (wt %), more preferably 65/35 to 45/55 (wt %). A high proportion of the low-melting point component tends to afford excellent spiral crimp development during thermal treatment. From that viewpoint, the proportion of first component is preferably high. On the other hand, a high proportion of the high-melting point component tends to reduce the stiffness of the fibers caused by the thermal treatment. From that viewpoint, the proportion of second component is preferably high. A good balance between resistance to reduction of stiffness and spiral crimp development by thermal treatment can be struck when the proportion of first component/second component is 75/25 to 35/65 (wt %). A yet better balance can be struck when the proportion of first component/second component is 65/35 to 45/55 (wt %).

The conjugate fiber for air-laid nonwoven fabric manufacture of the present invention is crimped. To afford good processability and high productivity during air laying, the crimp is a planar zig-zag crimp having a crimp shape index (actual length of short fiber/distance between both ends of short fiber) ranging from 1.05 to 1.60. More preferably, the crimp shape index ranges from 1.10 to 1.50.

The crimp shape index can be determined by taking images of short fibers using a digital microscope, and measuring the actual length of the short fibers and the distance between both ends of the short fibers. The overall crimp shape may be examined under the naked eye. The crimp shape is preferably a planar zig-zag crimp shape having acute-angle peak and valley sections, and not an Ω-shaped crimp shape having curved peak and valley sections, or not a spiral three-dimensional crimp.

When the conjugate form is configured such that the centers of gravity of the components are mutually different in the fiber cross section, as in the conjugate fiber of the present invention, a three-dimensional crimp shape such as a spiral shape, or a planar but curved crimp shape such as an Ω shape tend to occur resulting from subtle change caused in crimp shape on account of the difference between the stretch recovery ratios of two components after drawing, or as a result of heating during the fiber thermal treatment, crimping process or drying process. A rounded crimp shape of high crimp shape index is likely to be the result. When the fiber has a three-dimensional crimp shape or a curved crimp shape, the spread fibers become easily entangled with each other, which gives rise to lint ball-like defects and detracts from processability. Also, the spread fibers become highly bulky on account of the crimp shape. This impairs fiber discharge through a screen mesh during air laying, and lowers productivity.

When the crimp shape index is no greater than 1.60, the above problems are unlikely to occur, and satisfactory air laying processability can be achieved. Herein, a crimp shape index no greater than 1.50 affords sufficient air laying processability. When the crimp shape index is excessively small, on the other hand, the short fibers are almost straight. Fibers thus shaped fail to spread fully in the spreading step of the air laying process, and tend to be discharged as unspread fiber bundles. This gives rise to numerous defects that impair processability. A crimp shape index not lower than 1.05 affords satisfactory fiber spreading during the air laying process, while a crimp shape index not lower than 1.10 affords sufficient fiber spreading during the air laying process.

In the conjugate fiber for air-laid nonwoven fabric manufacture of the present invention, it becomes thus necessary to increase fiber spreadability, suppress entanglement between fibers, and to reduce the bulkiness of the spread fibers, by having a planar zig-zag crimp shape with a crimp shape index ranging from 1.05 to 1.60, more preferably from 1.10 to 1.50.

No particular limitations are imposed on the method for imparting a planar zig-zag crimp alone, with a crimp shape index ranging from 1.05 to 1.60, to a conjugate fiber of the present invention having the conjugate form in which the centers of gravity of the components are mutually different in the fiber cross section, without development of three-dimensional crimp or curved crimp. To that end, it is effective to use, in the second component, for instance a polypropylene (homo-polypropylene) having a comparatively wide molecular weight distribution, in which the numerical value of the ratio weight-average molecular weight/number-average molecular weight is preferably not smaller than 3.5, more preferably not smaller than 4.5.

The molecular weight distribution of polypropylene is ordinarily measured by GPC (Gel Permeation Chromatography). A molecular weight distribution curve is obtained by running a dilute solution of the polymer through a column packed with gel-like particles, and reading the differences in elution time that arise on account of differences in molecule size. Various numerical values such as the weight-average molecular weight, the number-average molecular weight, the viscosity-average molecular weight and the like are obtained on the basis of the molecular weight distribution curve. A widely used yardstick for molecular weight distribution is the so-called dispersion index, which is the numerical value resulting from dividing the weight-average molecular weight by the number-average molecular weight. A ratio weight-average molecular weight/number-average molecular weight closer to 1 denotes a narrower molecular weight distribution.

Ordinarily, polypropylene for fibers has often a higher MFR than polypropylene for other applications, such as films. Methods for obtaining high-MFR polypropylene include manufacturing methods in which there is polymerized polypropylene of comparatively low molecular weight, and MFR-increasing methods, in which there is polymerized a high-molecular weight polypropylene that is then subjected to peroxide modification, to increase the MFR. When using a method for obtaining high-MFR polypropylene by peroxide modification, the increase in MFR through scission of high-molecular weight chains takes place with a probability that is directly proportional to the length of the molecule chains. Therefore, the obtained high-MFR polypropylene has characteristically a narrow molecular weight distribution. This has the effect of enhancing spinnability and drawability, for which reason peroxide-modified polypropylene is widely used in fibers.

When polypropylene having a value 3.0 for the ratio weight-average molecular weight/number-average molecular weight, obtained for instance through peroxide modification, was used as the second component, which is the high-melting point component, a trend arose in that, even if a planar zig-zag crimp was tentatively imparted by feeding the drawn conjugate fiber into a stuffing box crimper, the fiber crimp obtained by running the fiber through the crimper, although planar, was likely to exhibit an Ω-like curved shape. Curved portions in the Ω-like crimp of the conjugate fiber tended to become gradually round over time, thereby causing the crimp shape index to rise. The same phenomenon was observed even when drying the conjugate fiber in a hot-air drier. After drying, the fibers were cut to 5 mm and were subjected to an air laying process, but fibers tangles formed readily, and numerous lint ball-like defects were observed in the web, which, although acceptable, precluded the web from being obtained to a sufficient level of uniformity. Also, dischargeability through the screen mesh failed to reach a sufficient level, and productivity, although acceptable, failed as well to reach a sufficient level.

By contrast, when there was used a polypropylene having value of 3.5 or greater for the ratio weight-average molecular weight/number-average molecular weight, the fibers that were run through the crimper exhibited only a planar zig-zag crimp, without development of Ω-like curved crimp such as the one described above, though the reasons for this are yet unclear. Observation over time of the conjugate fibers having such a planar zig-zag crimp revealed that the conjugate fibers preserved the planar zig-zag crimp, and moreover, that the conjugate fibers preserved the planar zig-zag crimp even when dried in a hot-air drier. After drying, these fibers were cut to a length of 5 mm and were subjected to an air laying process, whereupon the fibers exhibited a smaller crimp shape index than the above-described conjugate fibers having an Ω-like curved crimp. The conjugate fibers, which were clearly superior in terms of air laying processability and productivity, yielded a web of good texture with high productivity.

Using polypropylene having a value of 3.5 or higher for the ratio of weight-average molecular weight/number-average molecular weight allows satisfactorily suppressing the phenomenon of rounding and curving of the planar zig-zag crimp, which becomes likelier to occur over time, and/or during drying, as the molecular weight distribution of polypropylene, which is the second component, becomes wider. This suppressing effect is sufficient when the weight-average molecular weight/number-average molecular weight ratio is 4.5 or higher.

The upper limit of the value of the weight-average molecular weight/number-average molecular weight ratio of the polypropylene is not particularly restricted. However, an excessively high upper limit tends to impair spinnability. In terms of spinnability, therefore, the upper limit is preferably no greater than 10.0, more preferably no greater than 6.0. The weight-average molecular weight/number-average molecular weight ratio of the polypropylene is preferably no greater than 10.0 and not smaller than the above-described values, since in that case the above-described effects are elicited while affording simultaneously satisfactory spinnability. More preferably, the ratio is no greater than 6.0, since in that case the above-described effects are elicited while affording simultaneously sufficient spinnability.

Although not particularly limited thereto, the crimp count of the planar zig-zag crimp of the conjugate fiber for air-laid nonwoven fabric manufacture of the present invention ranges preferably from 6 to 14 crimps/2.54 cm, more preferably from 8 to 12 crimps/2.54 cm, with a view to increasing processability and productivity during air laying. A greater crimp count tends to result in a larger value of the crimp shape index (actual length of short fiber/distance between both ends of short fiber), even if when the crimp shape is a planar zig-zag shape. The crimp shape index can be easily kept within the above-described value range when the crimp count ranges from 6 to 14 crimps/2.54 cm, more preferably from 8 to 12 crimps/2.54 cm. A crimp count no greater than 14 crimps/2.54 cm affords a web of good texture with high productivity, without incurring lint ball-like defects caused by excessive fiber tangling, and without difficulty in discharge from the screen mesh resulting from excessive fiber bulkiness. When the crimp count is too small, fibers fail to spread sufficiently, which is liable to result in fiber bundle-like defects. Herein, a web of good texture, with good fiber spreading, can be obtained when the crimp count is not smaller than 6 crimps/2.54 cm. More preferably, the crimp count ranges from 8 to 12 crimps/2.54 cm, since in that case there can be obtained, with high productivity, a web of good and uniform texture free of fiber bundle-like and lint ball-like defects.

As described below, the conjugate fiber for air-laid nonwoven fabric manufacture of the present invention is cut to a fiber length of 3 to 20 mm. Measuring crimp count after cutting is difficult, and hence crimp count is preferably measured at a continuous fiber stage, before cutting of the crimped fibers. When the only available fibers are short fibers after cutting to a fiber length of 2.54 cm or less, the crimp count of the short fiber per fiber length may be measured, and the obtained value converted to a value per 2.54 cm, as a reference value.

The fiber length of the conjugate fiber for air-laid nonwoven fabric manufacture of the present invention ranges from 3 to 20 mm, preferably from 4 to 10 mm, and more preferably from 4 to 6 mm. In terms of air laying processability and productivity, a short fiber length is preferable. A fiber shorter than 20 mm results in satisfactory productivity and in acceptable occurrence of lint ball-like defects caused by fiber entangling. A fiber length no longer than 10 mm enhances productivity and results in very few lint ball-like defects. A fiber length no longer than 6 mm affords sufficient productivity with virtually no lint ball-like defects. From the viewpoint of achieving an air-laid nonwoven fabric in which fibers are amassed to a high density, by causing the web to shrink significantly, a long fiber length is preferable, since this results in a greater change in the apparent length of the conjugate fiber during development of spiral crimp, while the change in fiber shape, brought about by the spiral crimp, acts on numerous surrounding fibers, so that the fiber deforms dragging the surrounding fibers into movement of the deformation, and causing the web to shrink significantly as a result. A fiber length not shorter than 3 mm yields a satisfactory change in apparent length and satisfactory web shrinkage, namely a web shrinkage not lower than 40%. A fiber length not shorter than 4 mm yields sufficient web shrinkage. A fiber length ranging from 3 to 20 mm results in satisfactory air laying processability and productivity, and in a shrinkage not lower than 40% during web thermal treatment. A fiber length ranging from 4 to 10 mm results in a superior balance between process ability, productivity and web shrink characteristics. More preferably, fiber length ranges from 4 to 6 mm, since a yet better balance is struck within that range.

The single-yarn fineness of the conjugate fiber for air-laid nonwoven fabric manufacture of the present invention ranges from 1 to 10 dtex, more preferably from 1.5 to 5.0 dtex. A small single-yarn fineness results in spiral crimp of small pitch, a greater change in apparent fiber length, and high existence density of the fibers in the nonwoven fabric. By contrast, a large single-yarn fineness affords greater deformation forces of fiber shape during deformation through development of spiral crimp, and thereby surrounding fibers are also dragged into movement of the deformation, as a result of which the web shrinks significantly. When the single-yarn fineness ranges from 1 to 10 dtex, the fibers that form the web deform in such a manner that they drag surrounding fibers into movement of the deformation during development of spiral crimp, thereby causing the web to shrink significantly, and developing a fine spiral crimp, so that a high-density air-laid nonwoven fabric is obtained as a result. Preferably, the single-yarn fineness ranges from 1.5 to 5.0 dtex, since in that case the above-described effects are brought out in a well-balanced manner and there can be obtained an air-laid nonwoven fabric in which fibers are amassed to a higher density.

The short fiber bulkiness of the conjugate fiber for air-laid nonwoven fabric manufacture of the present invention is preferably small, in order to increase air laying processability and productivity. Herein, short fiber bulkiness denotes a value arrived at by causing 2 g of short fibers, spread by being run through an air-laying machine, for instance a Dan-web air-laid machine, to be air-spread again in a 1 L measuring cylinder having an inner diameter of 65 mm, after which a 20 g weight is placed on the short fibers. The volume of short fibers ($cm^3$/2 g) after a lapse of 10 minutes is the short fiber bulkiness. The value of short fiber bulkiness is not particularly limited, but is preferably no greater than 250 $cm^3$/2 g, more preferably no greater than 200 $cm^3$/2 g. The bulkiness of the short fibers depends on fiber length, and becomes smaller as the fiber length shortens. Short fiber bulkiness decreases when the crimp is a planar zig-zag crimp, with a small crimp shape index, and not a three-dimensional crimp or not a curved crimp. A small crimp count or a large single-yarn fineness yields a small short fiber bulkiness. Satisfactory air laying processability and productivity are achieved when the short fiber bulkiness is no greater than 250 $cm^3$/2 g, through appropriate control of, for instance, crimp shape, crimp count and fineness. Sufficient air laying processability and productivity are achieved when the short fiber bulkiness is no greater than 200 $cm^3$/2 g. As explained thus far the selection of crimp shape, crimp count, fineness and fiber length exert an influence on characteristics other than short fiber bulkiness. Hence, short fiber bulkiness is preferably selected in consideration of a balance with such other characteristics.

In the conjugate fiber for air-laid nonwoven fabric manufacture of the present invention, a surfactant is preferably adhered to the fiber surface in order to ensure processability and product characteristics. The type of surfactant is not particularly limited, but preferably a surfactant comprising a low-viscosity component is adhered to the fiber surface, where it lowers friction between fibers as well as friction between fibers and metals, with a view to enhancing air-laying processability and productivity. The surfactant can also be selected in order to enhance the characteristics of the obtained article. For instance, when the conjugate fiber is used in a liquid absorbing nonwoven fabric, there may be appropriately selected a surfactant comprising a hydrophilic component, or a surfactant comprising a lipophilic component, or a surfactant comprising a component that does not impair the characteristics of the liquid, in accordance with the properties of the liquid to be absorbed.

The amount of adhered surfactant is not particularly limited, but ranges preferably from 0.10 to 0.60 wt %, more preferably from 0.20 to 0.40 wt %, relative to fiber weight. A smaller adhesion amount tends to result in higher uniformity and in fewer defects in the web obtained by the air laying process. A web of satisfactory texture is obtained when the adhesion amount is no greater than 0.60 wt %. If the adhesion amount of is too small, the workability of the air laying process may be impaired on account of static electricity or the like. An adhesion amount of 0.10 wt % or greater allows eliciting a sufficient antistatic effect on the conjugate fiber of the present invention. An adhesion amount of ranging from 0.20 to 0.40 wt % allows obtaining a web of satisfactory texture with sufficiently stable workability.

The conjugate fiber for air-laid nonwoven fabric manufacture of the present invention has the above-described conjugate form, resin composition, crimp shape, crimp count, fineness, fiber length and the like, and hence the conjugate fiber of the present invention exhibits excellent spreadability in the air laying process, is little prone to entangling of spread fibers, and has excellent dischargeability through a screen mesh. The conjugate fiber of the present invention allows therefore obtaining an air-laid web of good texture. Although not particularly limited thereto, the air-laid web obtained through forming of the conjugate fiber of the present invention has preferably no more than 3 defects/$m^2$, more preferably not more than 1 defect/$m^2$. Examples of defects in the air-laid web include, for instance, unspread fiber bundles, lint ball-like defects caused by fiber entangling, or fiber clumps such as aggregates of fibers that fell on web after formed by fibers caught in the screen mesh. Although complete absence of defects is the ideal situation, a number of defects no greater than 3/$m^2$ is an acceptable level and a number of defects no greater than 1/$m^2$ is a satisfactory level, in terms of the characteristics and quality of the nonwoven fabric obtained through thermal treatment of the web.

A web can be obtained through an air laying process, with high productivity, since the conjugate fiber for air-laid nonwoven fabric manufacture of the present invention has the above-described conjugate form, resin composition, crimp shape, crimp count, fineness, fiber length and the like. Although not particularly limited thereto, the conjugate fiber of the present invention has a discharge efficiency not lower than 80%, more preferably not lower than 90%, during forming in an air-laying machine. The discharge efficiency, which is an index of air-laying productivity, denotes the ratio of the weight of short fibers actually discharged relative to the weight of short fibers fed to the air-laying machine. Discharge efficiency is given by the formula below.

$$\text{Discharge efficiency (\%)} = (\text{weight of discharged short fibers (g)} / \text{weight of fed short fibers (g)}) \times 100$$

In short fibers having low air-laying productivity, some short fibers fail to be discharged through the screen mesh and accumulate in the air-laying machine. In such a situation, discharge efficiency falls in that the weight of discharged short fibers decreases relative to the fed short fibers. That is, air-laying productivity can be grasped in a simple manner by assessing discharge efficiency, since a higher discharge efficiency translates into a higher air-laying productivity.

A discharge efficiency not lower than 80% affords an air-laid web obtained with satisfactorily high productivity. A discharge efficiency not lower than 90% affords sufficient productivity.

The conjugate fiber for air-laid nonwoven fabric manufacture of the present invention is formed as undrawn yarn in an ordinary melt spinning method, and is then drawn and imparted crimp. The above-described olefinic thermoplastic resins are used during melt spinning. The MFR of the starting-material resins is not particularly limited, and can be arbitrarily selected in such a manner that the MFR of the two components ranges preferably from 5 to 100 g/10 min, more preferably from 10 to 50 g/10 min, as described above, during ejection through the nozzle. MFRs of the starting-material resin that yield such numerical value ranges include, for instance, MFRs ranging preferably from 1 to 100 g/10 min, more preferably from 5 to 50 g/10 min.

The extrusion temperature and the nozzle temperature of the two components are not particularly limited, and can be appropriately selected taking into account, for instance, the MFR of the used starting-material resins, the MFR required upon ejection through the nozzle, as well as the spinnability and drawability of the undrawn yarn. Ordinarily, however, the extrusion temperature can range from 180 to 320° C., and the nozzle temperature can range from 220 to 300° C.

The spinning speed is not particularly limited, but ranges preferably from 300 to 1500 m/min, more preferably from 600 to 1000 m/min. A spinning speed not smaller than 300 m/min is preferred in terms of achieving satisfactory productivity, as such a speed corresponds to a large single-hole ejection amount when obtaining an undrawn yarn of arbitrary spinning fineness. A spinning speed no greater than 1500 m/min is preferable in terms of achieving an undrawn yarn preserving such an elongation as allows it to be sufficiently drawn in a subsequent drawing process. Particularly preferred is a spinning speed of 600 to 1000 m/min, since in that case an undrawn yarn can be obtained that strikes an excellent balance between productivity and drawability.

When taking up the fiber extruded through the spinning nozzle, the fiber is preferably cooled using a medium such as air, water, glycerin or the like, since doing so stabilizes the spinning process. Preferred among the foregoing is cooling by air, since in this case cooling can be realized using the simplest equipment.

An explanation follows next on a drawing method for obtaining the conjugate fiber for air-laid nonwoven fabric manufacture of the present invention. The drawing method is not particularly limited, and may be any known drawing method, for instance, drawing by contact heating using a metal heating roller or a metal heating plate, or drawing by non-contact heating using hot water, boiling water, pressurized saturated steam, hot air, far infrared rays, microwaves, or a carbon dioxide gas laser. Preferred among the foregoing is drawing using a metal heating roller or using hot water, in terms of, for instance, equipment simplicity, ease of operation and productivity.

The drawing temperature for obtaining the conjugate fiber for air-laid nonwoven fabric manufacture of the present invention is not particularly limited, but ranges preferably from 40 to 110° C., more preferably from 60 to 90° C. A high drawing temperature affords good spiral crimp development of the conjugate fiber during thermal treatment of the web, and allows thus the web to shrink significantly. An excessively high drawing temperature, however, may lead to agglutination of the low-melting point first component between adjacent fibers, thereby impairing fiber spreading during the air laying process. A drawing temperature ranging from 40 to 110° C. affords a web of good texture and capable of shrinking significantly, while a drawing temperature ranging from 60 to 90° C. affords simultaneously a high level of web uniformity and shrink characteristics.

The drawing ratio for obtaining the conjugate fiber for air-laid nonwoven fabric manufacture of the present invention is not particularly limited, but ranges preferably from 1.5 to 4.0, more preferably from 2.0 to 3.0. A high drawing ratio affords good spiral crimp development of the conjugate fiber during thermal treatment of the web, which allows the web to shrink significantly. A drawing ratio not smaller than 1.5 results in a satisfactorily high web shrinkage. On the other hand, a low drawing ratio tends to yield a completely planar zig-zag crimp having a small crimp shape index, without three-dimensional or curved crimp shapes, during crimping in a stuffing box crimper. A drawing ratio no greater than 4.0 is thus preferable in that it allows crimp to preserve a planar zig-zag shape, while affording excellent processability and productivity in the air laying process. Particularly preferred is a drawing ratio ranging from 2.0 to 3.0, which allows striking a satisfactory balance between web shrink characteristics and air-laying processability and productivity.

The drawing speed is not particularly limited, but is preferably not lower than 50 m/min, more preferably not lower than 100 m/min, with processability of the drawing process in mind. The drawing process may involve single-stage drawing or multistage drawing over two or more stages. Multistage drawing can be realized by combining drawing methods such as the above-mentioned hot roller drawing or hot water drawing. The drawing temperature at each drawing stage can be appropriately selected, and the drawing ratio at each drawing stage can be appropriately adjusted in such a way so as to obtain a desired total drawing ratio.

The method for imparting crimp to the conjugate fiber for air-laid nonwoven fabric manufacture of the present invention is not particularly limited, and may be a method using a known stuffing box crimper or a gear crimper. Preferred among the foregoing is a crimping method using a stuffing box crimper, since such a method allows imparting crimp at a high speed. It is preferable to heat the conjugate fiber when the fiber is fed into the crimper, since doing so affords a crimp shape of small crimp shape index by reducing the likelihood that the imparted crimp develops into so-called Ω-like crimp, in which the peak and valley sections of the crimp become curved. However, excessive heating of the conjugate fiber tends to result in low web shrinkage during thermal treatment of the air-laid web. Therefore, it is preferable to decide, considering a balance between web shrinkage and crimp shape in mind, whether or not to heat the conjugate fiber just before feeding into the crimper, and to decide the temperature up to which the conjugate fiber is heated.

Once crimp is imparted, there is preferably provided a drying step for removing moisture adhered to the fibers. The drying temperature is not particularly limited, but ranges preferably from 50 to 90° C., more preferably from 60 to 80° C. A temperature of 50° C. or higher allows the fibers to be sufficiently dried, and a temperature of 60° C. or higher allows drying to be efficiently carried out in a short time. A drying temperature not higher than 90° C. allows the fibers to retain their zig-zag crimp, and a temperature not higher than 80° C. allows the web to shrink significantly. Particularly preferred is a drying temperature ranging from 60 to 80° C., which allows combining a high level of workability of the drying process with a high level of the shrink characteristics of the web.

The fiber length of the conjugate fiber for air-laid nonwoven fabric manufacture of the present invention ranges from 3 to 20 mm, as described above. The method for achieving a desired fiber length in this range is not particularly limited, and may be a known method using, for instance, a rotary cutter, a guillotine cutter or the like.

The conjugate fiber for air-laid nonwoven fabric manufacture of the present invention is processed into a web by way of a so called air laying process that involves spreading short fibers using air, and dispersing and overlaying the spread fibers. The design of the air laying process, of which there are several, is not particularly limited, and the conjugate fiber of the present invention may be processed into a web in accordance with any known air laying process scheme. The conjugate fiber of the present invention has a planar zig-zag crimp shape with a crimp shape index of 1.05 to 1.60, and has a crimp count of 6 to 14 crimps/2.54 cm. Therefore, the conjugate fiber of the present invention is excellent in fiber spreadability and in dischargeability from a screen mesh in various air laying methods. The conjugate fiber of the present invention is also excellent in fiber dispersibility during overlaying of the discharged fibers on a conveyor net or the like. When using fibers having a crimp shape index greater than 1.60, with a three-dimensional crimp or a planar crimp but having a curved shape such as an Ω shape, the fibers are likely to fail to spread sufficiently during the spreading process, and to exhibit thus fiber bundle-like defects. Also, productivity becomes low on account of low dischargeability through the screen mesh, where fibers may accumulate. In addition, fiber accumulation gives rise to fiber tangling that favors formation of lint ball-like fiber. Also, the fibers that are discharged do not do so in a uniform manner, and thus a web of markedly uneven density is liable to be obtained. When using the conjugate fiber for air-laid nonwoven fabric manufacture of the present invention, by contrast, these problems are unlikely to occur, and a uniform air-laid web of good texture can be obtained with high productivity.

When the air-laid web comprising the conjugate fiber for air-laid nonwoven fabric manufacture of the present invention is subjected to a thermal treatment, the conjugate fiber develops a spiral crimp on account of the difference between the thermal shrinkage of the first component and the second component. The web itself shrinks significantly through shortening of the apparent length of the fibers during development of the spiral crimp, whereby there can be obtained a nonwoven fabric in which fibers are amassed to a high density.

The temperature during the thermal treatment of the air-laid web is not particularly limited, and can be appropriately selected in accordance with the resin composition of the conjugate fiber that is used, and in accordance with the characteristics required of the nonwoven fabric, but can range preferably from 120 to 150° C. A high thermal treatment temperature allows the conjugate fiber of the present invention to develop good spiral crimp, and the web to shrink significantly. Herein, thermal treatment carried out at a temperature not lower than 120° C. affords sufficient web shrinking. A low thermal treatment temperature allows the conjugate fiber of the present invention to preserve fiber shape in the web that has shrunk on account of the spiral crimp developed by the conjugate fiber, and allows obtaining a pliable nonwoven fabric. A nonwoven fabric having satisfactory pliability can be obtained when carrying out the thermal treatment at a temperature not higher than 150° C.

The thermal treatment method is not particularly limited, and may be any known thermal treatment method such as, for instance, air-through, floating, Yankee drying and the like. In order to shrink significantly as a result of the thermal treatment, the web is preferably subjected to the thermal treatment in as unconstrained a condition as possible. In the case of an air-through method, therefore, the volume of circulating air is preferably small. More preferably, the thermal treatment is carried out by floating.

The conjugate fiber of the present invention is suitable for web forming by an air laying process. Webs having high basis weight, for instance 500 g/m$^2$ or more, can be obtained easily, with good productivity, by way of an air laying process. When the air-laid web is subjected to a thermal treatment, the conjugate fiber develops a spiral crimp on account of the difference between the thermal shrinkage of the first component and the second component. The resulting shrinking of the apparent length of the fibers allows the web itself to shrink significantly. In this highly shrunk web, the spiral crimps of adjacent fibers are entangled with each other, forming an interlaced structure, so that the web becomes integrated as a single nonwoven fabric, even if portions of the first component, which is the low-melting point component of the conjugate fiber, do not become bonded to each other, or do so insufficiently. The existence density of fibers in the nonwoven fabric thus obtained is not particularly limited, but is preferably not lower than 30 mg/cm$^3$, more preferably not lower than 50 mg/cm$^3$. The existence density of fibers in the nonwoven fabric, arrived at through shrinking of the web on account of the thermal treatment, is calculated based on the formula below, upon measuring the weight and thickness of, the nonwoven fabric cut out to a given surface area.

$$\text{Existence density of fibers in the nonwoven fabric (mg/cm}^3\text{)} = \text{basis weight (g/m}^2\text{)/thickness (mm)}$$

An existence density of fibers not lower than 30 mg/cm$^3$ in the nonwoven fabric entails fibers amassed to a high density, so that neighboring fibers undergo sufficient interlacing among them and spiral crimps stretch and contract, eliciting thereby good resilience, pliability and stretchability. An existence density of fibers not lower than 50 mg/cm$^3$ affords yet better resilience, pliability and stretchability.

Ordinarily, the webs and nonwoven fabrics obtained by way of a carding process exhibit property anisotropy in that the fibers have a strong tendency to become arrayed in the machine direction, so that nonwoven fabric strength is substantial in the machine direction but less so in the width direction. By contrast, webs and nonwoven fabrics obtained by an air laying process exhibit characteristically little property differences, in terms of strength, elongation or the like, between the machine direction and the width direction of the nonwoven fabric, since the fibers are arranged randomly.

The line speed when obtaining a web by way of an air laying process is not particularly limited, but a lower speed results in smaller property differences between the machine direction and the width direction. Therefore, the line speed is preferably no greater than 50 m/min, more preferably no greater than 30 m/min.

The conjugate fiber for air-laid nonwoven fabric manufacture of the present invention exhibits an extremely random arrangement during web formation by way of an air laying process.

In the case of, for instance, an air-laid web laid to a high basis weight, for instance 500 g/m$^2$ or more, there is an appreciable number of fibers arranged at a certain angle in the vertical direction. During web shrinking through a thermal treatment, these fibers arranged in the vertical direction become bulked up and raised in the vertical direction through the opposing effect of contractile forces in the horizontal direction, while shrinking by developing their own spiral crimp. The fibers become further aligned thereby in the vertical direction. As a result, the high-density nonwoven fabric, obtained through thermal treatment of a web comprising the conjugate fiber for air-laid nonwoven fabric manufacture of the present invention can achieve high bulkiness efficiently, with fibers randomly arranged not only in the machine direction and the width direction but also in the thickness direction. The nonwoven fabric obtained is thus isotropic, exhibiting only slight differences, in the three spatial directions, as regards properties such as tensile strength, elongation, compression recovery and compression hardness.

Thanks to this property isotropy, the nonwoven fabric affords tridimensionally uniform liquid absorption and release when the nonwoven fabric is, for instance, a liquid absorbing material. When the nonwoven fabric is a cushioning material, the nonwoven fabric affords characteristics that cannot be achieved by way of a carding process, for instance high compression recovery characteristics in all directions.

As described above, the high-density air-laid nonwoven fabric obtained through thermal treatment of an air-laid web comprising the conjugate fiber of the present invention can be suitably used as a liquid absorbing material.

The conjugate fiber of the present invention comprises olefinic thermoplastic resins, and has thus excellent chemical resistance to liquids. A nonwoven fabric comprising, for instance, polyester fibers of polyethylene terephthalate or the like has low chemical resistance towards strong acids or alkalis, or organic solvents, and cannot be used in, for instance, oil-based marker pen ink absorbents. By contrast, a nonwoven fabric comprising polyolefin fibers of such as polypropylene or polyethylene, which are excellent in chemical resistance, exhibits itself also excellent chemical resistance, and can hence absorb, store and discharge all manner of liquids without undergoing property changes.

The nonwoven fabric having fibers amassed to a high density, obtained by thermally treating a web comprising the conjugate fiber of the present invention to develop thereby a small-pitch spiral crimp in the conjugate fiber that causes the web to shrink significantly, has voids, for instance, on the inward side of the spiral formed by the fibers or between fibers, such that the voids are suitable for eliciting capillarity effects. In addition, the size of these voids can be adjusted by suitable adjusting, for instance, the resin composition, the conjugate cross-sectional shape of the conjugate fiber of the present invention, and the spinning and drawing conditions, and by suitably controlling the conditions of the thermal treatment of the web comprising the conjugate fiber. The high-density air-laid nonwoven fabric obtained through thermal treatment of the conjugate fiber of the present invention, moreover, comprises fibers arranged randomly in three dimensions, and hence exhibits little differences in liquid absorption and release characteristics in the three spatial directions. The nonwoven fabric has thus the superior property of bringing about equal characteristics in all angles, when used, for instance, as the core of a marker pen, where a performance that releases ink is little affected by the writing angle, or when used as a wick for fragrance release, where a performance that release fragrance is almost same in all angles.

To obtain the air-laid web using the conjugate fiber for air-laid nonwoven fabric manufacture of the present invention, the air-laid web may be realized using the conjugate fiber of the present invention alone, by blending the conjugate fiber of the present invention with other synthetic fibers, or by blending the conjugate fiber of the present invention with other natural and/or inorganic fibers, or with particulate materials other than fibers.

To obtain for instance a liquid absorbing nonwoven fabric excellent in water absorption and retention, the conjugate fiber of the present invention can be blended with a material having excellent water absorption and retention characteristics, such as pulp or a high water-absorption resin powder. The blending ratios with other materials are not particularly limited, but the proportion of conjugate fiber of the present invention is preferably as high as possible, since this allows the web to shrink significantly, yielding in doing so a high-density air-laid nonwoven fabric. The ratio of the conjugate fiber of the present invention when blended with a plurality of other fibers to yield a web may be, for instance, not lower than 50 wt %, more preferably not lower than 75 wt %.

Examples of materials that can be blended to yield the web include, for instance, synthetic fibers, natural fibers and particulate materials. Examples of synthetic fibers include, for instance, single-component fibers comprising polypropylene, polyvinyl alcohol, polyethylene terephthalate or the like, as well as sheath/core conjugate fibers, eccentric sheath/core conjugate fibers, side-by-side conjugate fibers and split cross-section conjugate fibers in which there are conjugated two or more thermoplastic resins of differing melting points. Examples of natural fibers include, for instance, cellulosic fibers such as pulp or rayon, or animal hair fibers such as wool or cashmere. Examples of inorganic fibers include, for instance, glass fibers, carbon fibers and the like. Examples of particulate materials include, for instance, high water-absorption resin powders.

The air-laid web obtained using the conjugate fiber for air-laid nonwoven fabric manufacture of the present invention may be a single-layer web or a multilayer web having two or more layers.

In the air laying process, a web having a multilayer structure can be obtained easily by using a plurality of forming heads, and by appropriately selecting the type, blending ratio, amount and so forth of the fibers that are fed to each forming head.

When using for instance an air-laying machine comprising two forming heads, the first head, which forms the lower layer of the web, is fed a sheath-core conjugate fiber comprising sheath/core of high-density polyethylene/polypropylene, while the second head, which forms the upper layer of the web, is fed the conjugate fiber of the present invention, to form thereby a two-layer web. The resulting web is then subjected to a thermal treatment at 135° C. Thereupon, the conjugate fiber of the present invention that forms the second layer shrinks markedly, whereas the first layer undergoes virtually no shrinking. The obtained nonwoven fabric is curled as a result, with the second layer on the inward layer.

When using for instance an air-laying machine comprising three forming heads, the first head and the third head, which form the upper and lower layers of the web, are fed fibers that yield a web shrinkage of 0 to 10%, for instance a sheath-core conjugate fiber comprising a sheath/core of high-density polyethylene/polypropylene, while the second head, which forms the middle layer of the web, is fed the conjugate fiber of the present invention, that yields a web shrinkage not lower than 40%, to form thereby a three-layer web in which the basis weight ratio of the web upper layer/middle layer/lower layer is 30 to 60/10 to 30/30 to 60 wt %. The basis weight of the middle layer that can cause the web to shrink through development of spiral crimp by the fibers, upon thermal treatment at 135° C. of the three-layer web, is small. Moreover, the middle layer is flanked by an upper and lower web layer that exhibit virtually no shrinking. Hence, the middle layer does not elicit shrinking of the entire web, but gives rise to patchy shrinking, similar to the surface of a melon. As a result, the interior structure of the nonwoven fabric includes large voids, which results in a nonwoven fabric for absorbing articles having excellent liquid permeability.

EXAMPLES

The present invention is explained in detail below on the basis examples. The invention, however, is in no way meant to be limited to or by the examples. Definitions and methods for measuring the various characteristic values in the examples are set forth below.

(1) Melt Flow Rate (MFR) of the Thermoplastic Resin

MFR was measured at a test temperature of 230° C. and under a test load of 21.18 N. (JIS-K-7210 "Table 1", test condition 14)

(2) Single-Yarn Fineness

Single-yarn fineness was measured in accordance with JIS-L-1015, using continuous fibers. When measurement was difficult in that there were only available short fibers cut to 3 to 20 mm, measurements were carried out in accordance with method B, which is a simplified method. The fiber used in that case was measured by image analysis of short fiber images taken using a VC2400-IMU 3D Digital Fine Scope (by Omron).

(3) Crimp Count

Crimp count was measured in accordance with JIS-L-1015, using continuous fibers. When measurement was difficult in that there were only available short fibers cut to 3 to 20 mm, the crimp count per fiber length was measured, and the obtained value was converted to fineness per 2.54 cm, to yield a reference value, with n=100.

(4) Crimp Shape Index

Short fiber images were taken using a VC2400-IMU 3D Digital Fine Scope (by Omron), the actual length and distance between both ends of the short fiber were measured, and the crimp shape index was calculated on the basis the formula below, with n=20.

Crimp shape index=actual length of short fiber/distance between both ends of short fiber The overall crimp shape was observed under the naked eye, to sensorily grade the crimp shape into the three categories below.

Planar zigzag: the crimped fibers are planar, with acute-angle peak and valley sections.

Ω-shape: the crimped fibers are planar, but rounded, with curved peak and valley sections.

Spiral: spiral crimp, with three-dimensional crimped fibers.

(5) Molecular Weight Distribution of Polypropylene

The weight-average molecular weight and the number-average molecular weight were measured using a GPC-150C Plus (by Waters), with TSKgel GMH6-HT and TSKgel GMH6-HTL as separation columns. The molecular weight distribution was calculated on the basis the formula below. The column temperature was 140° C., the mobile phase was o-dichlorobenzene, the mobile flow rate was 1.0 ml/min, the sample concentration was 0.1 wt % and the sample injection amount was 500 μL.

Molecular weight distribution=weight-average molecular weight/number-average molecular weight (6) Melting Point of the Thermoplastic Resin A DSC measurement was carried out in accordance with the method set forth in JIS K7121, using a DSC-Q10 (by TA Instruments). The endothermic peak temperature in the obtained DSC curve was taken as the melting point.

(7) Short Fiber Bulkiness

To determine short fiber bulkiness, 2 g of short fibers were spread by being run through a Dan-web air-laying machine and were air-spread again in a 1 L measuring cylinder having an inner diameter of 65 mm, after which a 20 g weight was placed on the short fibers. The volume of short fibers ($cm^3$/2 g after a lapse of 10 minutes was taken as the short fiber bulkiness.

(8) Air-Laying Discharge Efficiency and Number of Defects in the Web

Short fibers were fed to an air-laying machine comprising a 600 mm-wide drum former DW-600 (by Dan-web) and a hole screen No. 1186-000 (hole size: 1.8 mm×25 mm, opening ratio: 35.9%), under conditions including needle roller revolutions of 1000 rpm, brush roller revolutions of 700 rpm, drum revolutions of 200 rpm, line speed of 5 m/min and suction air speed of 8 m/min, so as to yield short fibers having a basis weight of 200 g/$m^2$. The resulting web was sampled after 3 minutes. The obtained web was observed to count the number of defects including fiber bundles, lint balls and fiber clumps. The basis weight of the obtained web was measured, and air-laying discharge efficiency was calculated on the basis the formula below.

Discharge efficiency (%)=(weight of discharged short fibers/weight of fed short fibers)×100

(9) Web Shrinkage

The above-described air-laid web was cut into samples having a size of 25 cm×25 cm=machine direction×width direction, and then the samples were heated for 5 minutes at 145° C. in a circulation oven. Web shrinkage was calculated on the basis the formula below. Web shrinkage was averaged for the measurements in the machine direction and the width direction of the web.

Web shrinkage (%)=(web length before thermal treatment-web length after thermal treatment) ÷web length before thermal treatment×100

(10) Nonwoven Fabric Properties

The nonwoven fabric obtained in the above-described web shrinkage measurement was cut into samples, the surface area, weight and thickness whereof were measured to calculate the basis weight and existence density of fiber in the nonwoven fabric in accordance with the formulas below.

Nonwoven fabric basis weight (g/$m^2$)=nonwoven fabric weight (g) /nonwoven fabric surface area ($m^2$)

Existence density of fibers in the nonwoven fabric ($mg/cm^3$)=basis weight (g/$m^2$)/thickness (mm)

The uniformity of the nonwoven fabric was sensorily evaluated and graded into the three categories below.

O (good): no defects, no appreciable surface unevenness, sufficient uniformity.

Δ (fair): some defects, slight surface unevenness observable, but with satisfactory uniformity.

x (poor): numerous defects, or marked surface unevenness observable, poor uniformity.

In Examples 1 to 7 and Comparative examples 1 to 7 below there were manufactured various conjugate fibers, which were made into webs to manufacture various nonwoven fabrics. The properties of the conjugate fibers, the nonwoven fabrics and so forth are given in Tables 1 and 2.

Example 1

High-density polyethylene having a melting point of 130° C. and an MFR of 26 g/10 min, as the first component, and polypropylene having a melting point of 162° C., an MFR of 16 g/10 min, and a molecular weight distribution of 4.2, as the second component, conjugated at a ratio first component/second component of 50/50 wt %, were melt spun using a side-by-side nozzle at a first component extrusion temperature of 240° C., a second component extrusion temperature of 270° C. and a nozzle temperature of 260° C. The cross-sectional shape of the obtained undrawn yarn was a half-moon-like side-by-side shape. The undrawn yarn was drawn 2.0-fold at a drawing temperature of 50° C., and was imparted crimp in a stuffing box crimper. The crimp shape of the fibers coming out of the crimper was a planar zig-zag crimp shape. The same crimp shape was retained even after drying at 70° C. in a circulation drier. The crimp shape index was 1.28. The single-yarn fineness was 3.3 dtex and the crimp count 9.8 crimps/2.54 cm. The fiber was cut to 6 mm using a rotary cutter, to yield the conjugate fiber for air-laid nonwoven fabric manufacture. The short fiber bulkiness was 120 $cm^3$/2 g.

A web formed by an air laying process using the obtained conjugate fiber had good fiber spreadability and dischargeability. Upon subjecting the web to a thermal treatment at 145° C., the conjugate fiber developed a spiral crimp that elicited uniform shrinking of the web and yielded a high-density nonwoven fabric in which fibers were amassed to a high density. The nonwoven fabric was pliable and exhibited excellent cushioning characteristics in all spatial directions.

Example 2

A propylene-ethylene-butene-1 copolymer (weight ratio of propylene/ethylene/butene-1=93/2.5/4.5) having a melting point of 136° C. and an MFR of 18 g/10 min, as the first component, and polypropylene having a melting point of 162° C., an MFR of 11 g/10 min, and a molecular weight distribution of 4.9, as the second component, conjugated at a ratio first component/second component of 50/50 wt %, were melt spun using a side-by-side nozzle at a first component extrusion temperature of 290° C., a second component extrusion temperature of 270° C. and a nozzle temperature of 260° C. The cross-sectional shape of the obtained undrawn yarn was a side-by-side shape in which the second component was imperfectly enfolded in the first component. The undrawn yarn was drawn 3.0-fold at a drawing temperature of 60° C., and was imparted crimp in a stuffing box crimper. The crimp shape of the fibers coming out of the crimper was a planar zig-zag crimp shape. The same crimp shape was retained even after drying at 70° C. in a circulation drier. The crimp shape index was 1.39. The single-yarn fineness was 4.4 dtex and the crimp count 8.0 crimps/2.54 cm. The fiber was cut to 6 mm using a rotary cutter, to yield the conjugate fiber for air-laid nonwoven fabric manufacture. The short fiber bulkiness was 110 $cm^3$/2 g.

A web formed by an air laying process using the obtained conjugate fiber had good fiber spreadability and dischargeability. Upon subjecting the web to a thermal treatment at 145° C., the conjugate fiber developed a spiral crimp that elicited uniform shrinking of the web and yielded a high-density nonwoven fabric in which fibers were amassed to a high density. Although fibers did not bond sufficiently to each other, fiber interlacing was elicited in the shrinking process. The nonwoven fabric was pliable, had sufficient strength in all spatial directions, and exhibited excellent stretchability and resilience.

Example 3

The same resin combination of Example 2 was melt-spun at a first component extrusion temperature of 240° C., a second component extrusion temperature of 290° C. and a nozzle temperature of 260° C. The cross-sectional shape of the obtained undrawn yarn was a side-by-side shape in which the second component pushed into the first component. The undrawn yarn was drawn 2.2-fold at a drawing temperature of 60° C., and was imparted crimp in a stuffing box crimper. The crimp shape of the fibers coming out of the crimper was a planar zig-zag crimp shape. The same crimp shape was retained even after drying at 70° C. in a circulation drier. The crimp shape index was 1.18. The single-yarn fineness was 2.2 dtex and the crimp count 10.2 crimps/2.54 cm. The fiber was cut to 5 mm using a rotary cutter, to yield the conjugate fiber for air-laid nonwoven fabric manufacture. The short fiber bulkiness was 140 $cm^3$/2 g.

A web formed by an air laying process using the obtained conjugate fiber had good fiber spreadability and dischargeability. Upon subjecting the web to a thermal treatment at 145° C., the conjugate fiber developed a spiral crimp that elicited uniform shrinking of the web and yielded a high-density nonwoven fabric in which fibers were amassed to a high density. Although fibers did not bond sufficiently to each other, fiber interlacing was elicited in the shrinking process. The nonwoven fabric was pliable, had sufficient strength in all spatial directions, and exhibited excellent stretchability and resilience.

Example 4

The same resin combination of Example 2 was melt-spun at a first component extrusion temperature of 240° C., a second component extrusion temperature of 300° C. and a nozzle temperature of 260° C. The extrusion temperature of the second component was set 10° C. higher than that of Example 3. As a result, the MFR of the second component increased, so that the cross-sectional shape of the obtained undrawn yarn was a half-moon-like side-by-side shape. The undrawn yarn was drawn 2.5-fold at a drawing temperature of 80° C., and was imparted crimp in a stuffing box crimper. The crimp shape of the fibers coming out of the crimper was a planar zig-zag crimp shape. The same crimp shape was retained even after drying at 70° C. in a circulation drier. The crimp shape index was 1.26. The single-yarn fineness was 2.2 dtex and the crimp count 10.6 crimps/2.54 cm. The fiber was cut to 5 mm using a rotary cutter, to yield the conjugate fiber for air-laid nonwoven fabric manufacture. The short fiber bulkiness was 160 $cm^3$/2 g.

A web formed by an air laying process using the obtained conjugate fiber had good fiber spreadability and dischargeability. Upon subjecting the web to a thermal treatment at 145° C., the conjugate fiber developed a spiral crimp that elicited uniform shrinking of the web and yielded a high-density nonwoven fabric in which fibers were amassed to a high density. Both web shrinkage and nonwoven fabric density were higher than those of Example 3. The air-laid nonwoven fabric obtained exhibited thus a higher density. This is believed to result from the conjugate cross-sectional shape, which is herein a half-moon-like side-by-side shape, as well as from the high drawing temperature and the large drawing ratio. Although fibers did not bond sufficiently to each other, fiber interlacing was elicited in the shrinking process. The nonwoven fabric was pliable, had sufficient strength in all spatial directions, and exhibited excellent stretchability and resilience.

Example 5

A propylene-ethylene-butene-1 copolymer (weight ratio of propylene/ethylene/butene-1=92/3.5/4.5) having a melting point of 140° C. and an MFR of 11 g/10 min, as the first component, and polypropylene having a melting point of 160° C., an MFR of 9 g/10 min, and a molecular weight distribution of 3.6, as the second component, conjugated at a ratio first component/second component of 50/50 wt %, were melt spun using a side-by-side nozzle at a first component extrusion temperature of 290° C., a second component extrusion temperature of 310° C. and a nozzle temperature of 260° C. The cross-sectional shape of the obtained undrawn yarn was a half-moon-like side-by-side shape. The undrawn yarn was drawn 2.5-fold at a drawing temperature of 80° C., and was imparted crimp in a stuffing box crimper. The crimp shape of the fibers coming out of the crimper was a planar zig-zag crimp shape. The planar zig-zag crimp shape was retained even after drying at 70° C. in a circulation drier, although the edges of the peaks and valleys of the crimp slacked slightly. The crimp shape index was 1.42. The single-yarn fineness was 2.2 dtex and the crimp count 12.3 crimps/2.54 cm. The fiber was cut to 5 mm using a rotary cutter, to yield the conjugate fiber for air-laid nonwoven fabric manufacture. The short fiber bulkiness was 240 $cm^3$/2 g.

In the web formed by an air laying process using the obtained conjugate fiber, discharge efficiency dropped to 88% due to the slightly large short-fiber bulkiness. Nonetheless, the web exhibited satisfactory fiber spreadability and dischargeability. Upon subjecting the web to a thermal treatment at 145° C., the conjugate fiber developed a spiral crimp that elicited uniform shrinking of the web and yielded a high-density nonwoven fabric in which fibers were amassed to a high density. Although fibers did not bond sufficiently to each other, the nonwoven fabric was pliable, had sufficient strength in all spatial directions, and exhibited excellent stretchability and resilience.

Example 6

Low-density polyethylene having a melting point of 102° C. and an MFR of 23 g/10 min, as the first component, and a propylene-ethylene-butene-1 copolymer (weight ratio of prop ylene/ethylene/butene-1=92/3.5/4.5) having a melting point of 140° C. and an MFR of 11 g/10 min, as the second component, conjugated at a ratio first component/second component of 40/60 wt %, were melt spun using a side-by-side nozzle at a first component extrusion temperature of 200° C., a second component extrusion temperature of 250° C. and a nozzle temperature of 260° C. The cross-sectional shape of the undrawn yarn was a side-by-side shape in which the second component was imperfectly enfolded in the first component. The undrawn yarn was drawn 2.5-fold at a drawing temperature of 60° C., and was imparted crimp in a stuffing box crimper. The crimp shape of the fibers coming out of the crimper was a planar zig-zag crimp shape. The planar zig-zag crimp shape was retained even after drying at 70° C. in a circulation drier, although the edges of the peaks and valleys of the crimp slacked slightly due to using the propylene-ethylene-butene-1 copolymer in the second component. The crimp shape index was 1.54. The single-yarn fineness was 3.3 dtex and the crimp count 11.1 crimps/2.54 cm. The fiber was cut to 4 mm using a rotary cutter, to yield the conjugate fiber for air-laid nonwoven fabric manufacture. The short fiber bulkiness was 220 $cm^3$/2 g.

In the web formed by an air laying process using the obtained conjugate fiber, discharge efficiency dropped to 86% due to the slightly large short fiber bulkiness, and on account of the low-density polyethylene, having high friction, being exposed at the fiber surface. Nonetheless, the web exhibited acceptable fiber spreadability and dischargeability. Upon subjecting the web to a thermal treatment at 145° C., the conjugate fiber developed a spiral crimp that elicited uniform shrinking of the web and yielded a high-density nonwoven fabric in which fibers were amassed to a high density. The nonwoven fabric was excellent in pliability since low-density polyethylene was used on the fiber surface. Also, the nonwoven fabric exhibited excellent stretchability and resilience in all spatial directions, on account of the spiral crimp.

Example 7

Melt spinning was carried out in the same way as in Example 4, but using herein polypropylene having a melting point of 164° C., an MFR of 9 g/10 min, and a molecular weight distribution of 3.0 as the second component. The cross-sectional shape of the obtained undrawn yarn was a half-moon-like side-by-side shape. The undrawn yarn was drawn 2.0-fold at a drawing temperature of 80° C., and was imparted crimp in a stuffing box crimper. The crimp shape of the fibers coming out of the crimper was a planar zig-zag crimp shape. The planar zig-zag crimp shape was retained even after drying at 70° C. in a circulation drier, although the edges of the peaks and valleys of the crimp slacked slightly. The crimp shape index was 1.56. This is thought to arise from the molecular weight distribution of the polypropylene in the second component, of 3.0, which is lower than 4.9 for Example 4. The single-yarn fineness was 2.8 dtex and the crimp count 10.4 crimps/2.54 cm. The fiber was cut to 5 mm using a rotary cutter, to yield the conjugate fiber for air-laid nonwoven fabric manufacture. The short fiber bulkiness was 240 $cm^3$/2 g.

In the web formed by an air laying process using the obtained conjugate fiber, discharge efficiency dropped to 88% due to the slightly large short fiber bulkiness. Nonetheless, the web exhibited acceptable fiber spreadability and dischargeability. Upon subjecting the web to a thermal treatment at 145° C., the conjugate fiber developed a spiral crimp that elicited uniform shrinking of the web and yielded a high-density nonwoven fabric in which fibers were amassed to a high density. The nonwoven fabric was excellent in pliability, and exhibited excellent stretchability and resilience in all spatial directions, on account of the spiral crimp.

Comparative Example 1

Melt spinning was carried out in the same way as in Example 1, but using herein a concentric sheath/core nozzle. The cross-sectional shape of the obtained undrawn yarn was a concentric sheath/core shape. The undrawn yarn was drawn and crimped in a stuffing box crimper in the same way as in Example 1. The crimp shape of the fibers coming out of the crimper was a planar zig-zag crimp shape. The same crimp shape was retained even after drying at 70° C. in a circulation drier. The crimp shape index was 1.14. The single-yarn fineness was 3.3 dtex and the crimp count 10.5 crimps/2.54 cm. The fiber was cut to 6 mm using a rotary cutter, to yield the conjugate fiber for air-laid nonwoven fabric manufacture. The short fiber bulkiness was 100 $cm^3$/2 g.

A web formed by an air laying process using the obtained conjugate fiber had good fiber spreadability and dischageability. The web was thermally treated at 145° C., but unlike the conjugate fiber of Example 1, which developed spiral crimp causing the web to shrink significantly and uniformly, the conjugate fiber of Comparative example 1 failed to develop spiral crimp, which precluded the web from shrinking significantly. Therefore, the obtained nonwoven fabric had a very low fiber existence density. Although the nonwoven fabric had a soft feel on account of its bulkiness, the nonwoven fabric lacked the pliability and cushioning that are imparted by spiral crimp in the fibers.

Comparative Example 2

Melt spinning was carried out in the same way as in Example 2, but using now a concentric sheath/core nozzle. The cross-sectional shape of the obtained undrawn yarn was a concentric sheath/core shape. The undrawn yarn was drawn and crimped in a stuffing box crimper under the same conditions as in Example 2, but at a drawing temperature of 90° C. The crimp shape of the fibers coming out of the crimper was a planar zig-zag crimp shape. The same crimp shape was retained even after drying at 70° C. in a circulation drier. The crimp shape index was 1.11. The single-yarn fineness was 4.4 dtex and the crimp count 13.6 crimps/2.54 cm. The fiber was cut to 6 mm using a rotary cutter, to yield the conjugate fiber for air-laid nonwoven fabric manufacture. The short fiber bulkiness was 140 $cm^3$/2 g.

A web formed by an air laying process using the obtained conjugate fiber had good fiber spreadability and dischargeability. Although the web was thermally treated at 145° C., the conjugate fiber failed to develop spiral crimp, as in Comparative example 1, which precluded the web from becoming highly shrunk Therefore, the obtained nonwoven fabric had a very low fiber existence density. Also, bonding between fibers was slight but insufficient, and there formed no fiber interlacing such as the one formed in Example 2. The strength of the nonwoven fabric was in consequence markedly low. The nonwoven fabric, moreover, lacked the pliability and cushioning that are imparted by spiral crimp in the fibers.

Comparative Example 3

The undrawn yarn of Example 7 was drawn 2.8-fold at a drawing temperature of 80° C., and was imparted crimp in a stuffing box crimper. The crimp shape of the fibers coming out of the crimper was an Ω-like shape with peaks and valleys having curved edges. Upon drying at 70° C. in a circulation drier, the curving of the edges became more distinct, and the crimp shape index increased to 1.82, in a so-called Ω-like shape. The causes for this are believed to include the small molecular weight distribution, of 3.0, of the polypropylene in the second component, and the drawing ratio, which was higher than that of Example 7. The single-yarn fineness was 2.0 dtex and the crimp count 10.9 crimps/2.54 cm. The fiber was cut to 5 mm using a rotary cutter, to yield the conjugate fiber for air-laid nonwoven fabric manufacture. The short fiber bulkiness was 270 $cm^3$/2 g.

The obtained conjugate fiber was made into a web by an air laying process, but the fibers became entangled with each other, while their high bulkiness prevented them from being fully discharged through the screen mesh, where they accumulated. Discharge efficiency dropped to 58%. Also, the obtained web exhibited numerous lint ball-like and fiber clump-like defects. The defects persisted upon thermal treatment of the web at 145° C. As a result, shrinking of the web was irregular, and the obtained nonwoven fabric was too uneven to measure the density. The texture of the nonwoven fabric was unsatisfactory.

Comparative Example 4

In accordance with the method set forth in Example 2 of JP 02-127553 A, a propylene-ethylene-butene-1 copolymer (weight ratio of propylene/ethylene/butene-1=92/3.5/4.5) having a melting point of 140° C. and an MFR of 11 g/10 min, as the first component, and polypropylene having a melting point of 164° C., an MFR of 8.5 g/10 min, and a molecular weight distribution of 5.0, as the second component, conjugated at a ratio first component/second component of 50/50 wt %, were melt spun using a side-by-side nozzle at a first component extrusion temperature of 280° C., a second component extrusion temperature of 280° C. and a nozzle temperature of 260° C. The cross-sectional shape of the obtained undrawn yarn was a side-by-side shape in which the second component pushed into the first component. The undrawn yarn was drawn 3.5-fold at a drawing temperature of 70° C., and was imparted crimp in a stuffing box crimper. Although planar, the crimp shape of the fibers coming out of the crimper was an Ω-like shape with peaks and valleys having curved edges. This is believed to arise from the increased difference in elastic recovery between the two components during release of the drawing tension in the crimp-imparting process, since the undrawn yarn was drawn at a high drawing ratio, of 3.5. Upon drying at 70° C. in a circulation drier, shape change on account of the differences in elastic recovery became more evident, with pronounced curving of peaks and valleys in the crimp that resulted in a Ω shape. The crimp shape index was 1.88. The single-yarn fineness was 1.7 dtex and the crimp count 18.0 crimps/2.54 cm. The fiber was cut to 5 mm using a rotary cutter, to yield the conjugate fiber for air-laid nonwoven fabric manufacture. Short fiber bulkiness was extremely large, of 330 $cm^3$/2 g, on account of the Ω-like crimp shape and the large crimp count, of 18.0 crimps/2.54 cm.

The obtained conjugate fiber was made into a web by an air laying process, but the fibers became entangled with each other, while their high bulkiness prevented them from being fully discharged through the screen mesh, where they accumulated. Discharge efficiency dropped to 46%. Also, the obtained web exhibited numerous lint ball-like and fiber clump-like defects. The defects persisted upon thermal treatment of the web at 145° C. As a result, shrinking of the web was irregular, and the obtained nonwoven fabric was too uneven to measure the density. The texture of the nonwoven fabric was unsatisfactory.

Comparative Example 5

In accordance with the method set forth in Example 7 of JP 11-61614 A, a propylene-ethylene-butene-1 copolymer (weight ratio of propylene/ethylene/butene-1=93/2.5/4.5) having a melting point of 136° C. and an MFR of 18 g/10 min, as the first component, and polypropylene having a melting point of 165° C., an MFR of 22 g/10 min, and a molecular weight distribution of 3.0, as the second component, conjugated at a ratio first component/second component of 50/50 wt %, were melt spun using a side-by-side nozzle at a first component extrusion temperature of 240° C., a second component extrusion temperature of 260° C. and a nozzle temperature of 260° C. The cross-sectional shape of the obtained undrawn yarn was a side-by-side shape in which the second component pushed into the first component. The obtained undrawn yarn was drawn while adjusting various conditions, to yield a spiral crimp having a crimp count of 6.1 crimps/2.54 cm. The crimp shape index was 1.66. The fiber was cut to 8 mm using a rotary cutter, to yield the conjugate fiber for air-laid nonwoven fabric manufacture. Short fiber bulkiness was extremely large, of 280 $cm^3$/2 g, on account of the spiral crimp shape and the fiber length of 8 mm.

The obtained conjugate fiber was made into a web by an air laying process, but the fibers failed to spread on account of the spiral crimp shape, while fibers that did spread became readily entangled with each other. Fiber length was long and bulkiness high, which prevented the fibers from being discharged through the screen mesh, where they accumulated. Discharge efficiency dropped to 44%. Also, the obtained web exhibited numerous lint ball-like and fiber clump-like defects. The defects persisted upon thermal treatment of the web at 145° C. As a result, shrinking of the web was irregular, and the obtained nonwoven fabric was too uneven to measure the density. The texture of the nonwoven fabric was unsatisfactory.

Comparative Example 6

In accordance with the method set forth in Example 3 of JP 2003-171860 A, high-density polyethylene having a melting point of 130° C. and an MFR of 26 g/10 min, as the first component, and polyethylene terephthalate having a melting point of 256° C. and an intrinsic viscosity (Iv value) of 0.64, as the second component, conjugated at a ratio first component/second component of 50/50 wt %, were melt spun using an eccentric core/sheath hollow nozzle at a first component extrusion temperature of 250° C., a second component extrusion temperature of 290° C. and a nozzle temperature of 260° C. In the cross-sectional shape of the obtained undrawn yarn, the second component, which was the core component, was off-center and had a hollow portion. The obtained undrawn yarn was drawn 3.0-fold in hot water at 70° C., and was imparted crimp in a stuffing box crimper. The crimp shape of the fibers coming out of the crimper was a planar zig-zag crimp shape. The crimp shape index was 1.21. The single-yarn fineness was 2.4 dtex and the crimp count 11.2 crimps/2.54 cm. The fiber was cut to 5 mm using a rotary cutter, to yield the conjugate fiber for air-laid nonwoven fabric manufacture. Because the core component used was highly stiff polyethylene terephthalate, the short fiber bulkiness, of 230 $cm^3$/2 g, was higher than that of polyolefin conjugate fibers having comparable fineness, fiber length, crimp count and crimp shape.

The obtained conjugate fiber was formed into a web by an air laying process. The discharge efficiency was 91%, and the number of defects in the web was 2/$m^2$. The web, of satisfactory uniformity, was formed with satisfactory productivity. The web was subjected to a thermal treatment at 145° C., whereupon the fibers developed a spiral crimp, yielding a high-bulkiness nonwoven fabric. However, the web failed to shrink overall, which it did in the case of the polyolefin conjugate fibers disclosed in the examples. Thus, a nonwoven fabric having fibers amassed to a high density could not be obtained. The web was further subjected to a thermal treatment at 165° C., but the web failed again to shrink overall, so that a nonwoven fabric having fibers amassed to a high density could not be obtained. The obtained nonwoven fabric had a very low fiber existence density. Although the nonwoven fabric had a soft feel on account of its bulkiness, the nonwoven fabric lacked the pliability and cushioning that are imparted by spiral crimp in the fibers.

Comparative Example 7

In accordance with the method set forth in Example 2 of JP 02-127553 A, The undrawn yarn prepared in Comparative example 4 was cut to 65 mm to yield a conjugate fiber for manufacturing a carded nonwoven fabric. The crimp shape index was 1.94. Short fiber bulkiness could not be measured owing to excessive fiber entangling.

The obtained conjugate fiber was made into a web using a miniature carding machine. A 200 g/$m^2$ web could not be obtained, and hence plural webs were overlaid so as to yield 200 g/$m^2$. The web was subjected to a thermal treatment at 145° C., whereupon the fibers developed a spiral crimp. However, the fiber arrangement was biased towards the machine direction. Therefore, the web exhibited strong shrinking in the machine direction, but little shrinkage in the width direction. In the web, moreover, no fibers were arranged in the thickness direction, and there was observed no fiber behavior in which the fibers are raised up during the shrinking process. Although the nonwoven fabric obtained through shrinking exhibited therefore strong stretchability and high resilience in the machine direction, stretchability and resilience were remarkably poor in the width direction and the thickness direction. The shrink behavior of the web tended be biased, reflecting the little freedom of the fibers in the web. The uniformity of the shrunk high-density nonwoven fabric, although acceptable in terms of, for instance, small irregularities visible on the surface of the nonwoven fabric, was not satisfactory enough.

TABLE 1

| | First component | Second component | PP molecular weight distribution | Conjugate cross-sectional shape | Drawing temp. ° C. | Drawing ratio | Fineness dtex | Fiber length mm | Crimp shape | Crimp shape index | Crimp count crimps/2.54 cm | Short fiber bulkiness $cm^3$/2 g |
|---|---|---|---|---|---|---|---|---|---|---|---|---|
| Example 1 | HDPE | PP | 4.2 | ⦶ | 50 | 2.0 | 3.3 | 6 | Zig-zag | 1.28 | 9.8 | 120 |
| Example 2 | co-PP | PP | 4.9 | ⦶ | 60 | 3.0 | 4.4 | 6 | Zig-zag | 1.39 | 8.0 | 110 |
| Example 3 | co-PP | PP | 4.9 | ⦶ | 60 | 2.2 | 2.2 | 5 | Zig-zag | 1.18 | 10.2 | 140 |
| Example 4 | co-PP | PP | 4.9 | ⦶ | 80 | 2.5 | 2.2 | 5 | Zig-zag | 1.26 | 10.6 | 160 |
| Example 5 | co-PP | PP | 3.6 | ⦶ | 80 | 2.5 | 2.2 | 5 | Zig-zag | 1.42 | 12.3 | 240 |
| Example 6 | LDPE | co-PP | — | ⦶ | 60 | 2.5 | 3.3 | 4 | Zig-zag | 1.54 | 11.1 | 220 |
| Example 7 | co-PP | PP | 3.0 | ⦶ | 80 | 2.0 | 2.8 | 5 | Zig-zag | 1.56 | 10.4 | 240 |
| Comp. ex. 1 | HDPE | PP | 4.2 | ◎ | 50 | 2.0 | 3.3 | 6 | Zig-zag | 1.14 | 10.5 | 100 |
| Comp. ex. 2 | co-PP | PP | 4.9 | ◎ | 90 | 3.0 | 4.4 | 6 | Zig-zag | 1.11 | 13.6 | 140 |
| Comp. ex. 3 | co-PP | PP | 3.0 | ⦶ | 80 | 2.8 | 2.0 | 5 | Ω shape | 1.82 | 10.9 | 270 |
| Comp. ex. 4 | co-PP | PP | 5.0 | ⦶ | 70 | 3.5 | 1.7 | 5 | Ω shape | 1.88 | 18.0 | 330 |

TABLE 1-continued

| | First component | Second component | PP molecular weight distribution | Conjugate cross-sectional shape | Drawing temp. ° C. | Drawing ratio | Fineness dtex | Fiber length mm | Crimp shape | Crimp shape index | Crimp count crimps/2.54 cm | Short fiber bulkiness $cm^3/2$ g |
|---|---|---|---|---|---|---|---|---|---|---|---|---|
| Comp. ex. 5 | co-PP | PP | 3.0 | ◐ | 90 | 3.8 | 1.8 | 8 | 3D | 1.66 | 6.1 | 280 |
| Comp. ex. 6 | HDPE | PET | — | ◎ | 70 | 3.0 | 2.4 | 5 | Zig-zag | 1.21 | 11.2 | 230 |
| Comp. ex. 7 | co-PP | PP | 5.0 | ◐ | 70 | 3.5 | 1.7 | 65 | Ω shape | 1.94 | 18.0 | — |

PP: polypropylene
co-PP: propylene copolymer
HDPE: high-density polyethylene
LDPE: low-density polyethylene
PET: polyethylene terephthalate

TABLE 2

| | Discharge efficiency % | Web defects/ $m^2$ | Web shrinkage % | Nonwoven fabric basis weight $g/m^2$ | Nonwoven fabric density $mg/cm^3$ | Nonwoven fabric uniformity |
|---|---|---|---|---|---|---|
| Example 1 | 98 | 1 | 42 | 580 | 35 | ○ |
| Example 2 | 97 | 1 | 48 | 720 | 48 | ○ |
| Example 3 | 97 | 1 | 52 | 840 | 53 | ○ |
| Example 4 | 96 | 2 | 62 | 1330 | 65 | ○ |
| Example 5 | 88 | 3 | 67 | 1610 | 67 | Δ |
| Example 6 | 86 | 3 | 49 | 660 | 51 | Δ |
| Example 7 | 88 | 3 | 62 | 1220 | 71 | Δ |
| Comp. ex. 1 | 99 | 0 | 7 | 230 | 21 | ○ |
| Comp. ex. 2 | 93 | 1 | 13 | 260 | 26 | ○ |
| Comp. ex. 3 | 58 | 8 | 59 | 690 | — | x |
| Comp. ex. 4 | 46 | 18 | 54 | 430 | — | x |
| Comp. ex. 5 | 44 | 24 | 67 | 810 | — | x |
| Comp. ex. 6 | 91 | 2 | 15 | 300 | 15 | ○ |
| Comp. ex. 7 | — | — | 52 | 868 | 35 | Δ |

The invention claimed is:

1. A method for manufacturing a nonwoven fabric, comprising:

obtaining a web from a heat-fusible conjugate short fiber through an air laying process; and thermally treating the web, wherein the heat-fusible conjugate short fiber comprises a first component and a second component, wherein the first component comprises an olefinic thermoplastic resin and is conjugated with the second component, which comprises an olefinic thermoplastic resin having a melting point higher than that of the first component, wherein a conjugate form of the first component and the second component is a side-by-side shape or eccentric core/sheath shape such that centers of gravity of the first component and the second component are mutually different in a fiber cross section of the conjugate short fiber, and the conjugate short fiber has:

a single-yarn fineness in a range from 1 to 10 dtex, a fiber length in a range from 3 to 20 mm, a planar zig-zag crimp whose crimp shape index, which is a ratio of an actual length of the conjugate short fiber/distance between both ends of the conjugate short fiber, ranges from 1.05 to 1.60, and a crimp count ranging from 6 to 12.3 crimps/2.54 cm.

2. The method according to claim 1, wherein the conjugate form in the fiber cross section is the side-by-side shape in which a half-moon-shaped first component and a half-moon-shaped second component are bonded together.

3. The method according to claim 1, wherein the first component is a polypropylene copolymer and the second component is homopolypropylene.

4. The method according to claim 3, wherein molecular weight distribution, which is a ratio of weight-average molecular weight/number-average molecular weight, of the homopolypropylene of the second component is not smaller than 3.5.

5. The method according to claim 1, wherein short fiber bulkiness of the conjugate short fiber is no greater than 250 $cm^3/2$ g.

6. The method according to claim 1, wherein said air laying process is performed by an air-laying machine having a discharge efficiency that is not lower than 80%, and wherein a number of defects in the web obtained by the air-laying machine is no greater than $3/m^2$.

7. The method according to claim 1, wherein the melting point of the first component ranges from 80° C. to 150° C., and the melting point of the second component ranges from 40° C. to 200° C.

8. The method according to claim 1, wherein said thermally treating step is performed at a temperature in a range from 120° C. to 150° C.

9. The method according to claim 1, further comprising:

melt spinning the first component and the second component to obtain an undrawn yarn, drawing the undrawn yarn, and imparting crimp to the drawn yarn to obtain the heat-fusible conjugate short fiber.

10. The method according to claim 9, wherein the drawing comprises drawing the undrawn yarn with a drawing temperature ranging from 60 to 90° C.

11. The method according to claim 9, wherein the drawing comprises drawing the undrawn yarn with a drawing ratio ranging from 2.0 to 3.0.

* * * * *